US006042023A

United States Patent [19]

Ask

[11] Patent Number: 6,042,023

[45] Date of Patent: Mar. 28, 2000

[54] AUTOMATIC DEICING UNIT

[75] Inventor: Bernard J. Ask, St. Simons Island, Ga.

[73] Assignee: Odin Systems International, Inc., St. Simons Island, Ga.

[21] Appl. No.: 09/018,846

[22] Filed: Feb. 6, 1998

Related U.S. Application Data

[60] Provisional application No. 60/037,136, Feb. 13, 1997.

[51] Int. Cl.[7] ..... B05B 17/00

[52] U.S. Cl. ..... 239/272; 239/309; 239/379; 239/450; 239/1

[58] Field of Search ..... 239/1, 71, 75, 239/152, 266, 268, 271, 272, 302, 309, 329–331, 379, 450; 222/325, 88, 82; 141/330

[56] References Cited

U.S. PATENT DOCUMENTS

| | | | |
|---|---|---|---|
| 3,201,006 | 8/1965 | Bernhardt | 222/330 |
| 3,540,655 | 11/1970 | Hinrichs | 239/75 |
| 4,161,280 | 7/1979 | Kasinakas | 239/1 |
| 4,209,131 | 6/1980 | Barash et al. | 239/68 |
| 4,852,802 | 8/1989 | Iggulden et al. | 239/64 |
| 4,895,303 | 1/1990 | Freyvogel | 239/61 |
| 4,905,904 | 3/1990 | Ohara et al. | 222/88 X |
| 4,941,806 | 7/1990 | Brown et al. | 239/309 X |
| 5,021,939 | 6/1991 | Pulgiese | 364/143 |
| 5,060,859 | 10/1991 | Bancroft | 239/64 |
| 5,148,826 | 9/1992 | Bakhshaei | 137/80 |
| 5,287,888 | 2/1994 | Geiger | 137/624.2 |
| 5,447,272 | 9/1995 | Ask | 239/7 |

OTHER PUBLICATIONS

Odin Systems, "Automated Anti–Icing Systems Extend The Reach Of Winder Road Maintenance Crews", Brochure, 1997.

Maintenance Specialties, Inc. "Training and Implementation of Technology as a Means of Reducing the Cost of Maintenance" Brochure.

*Primary Examiner*—Lesley D. Morris

*Attorney, Agent, or Firm*—James Creighton Wray; Meera P. Narasimhan

[57] ABSTRACT

The present invention is a stationary, portable deicing machine for preventing snow and ice build up on any targeted surface, such as driveways, walkways and rooftops. The invention is a compact, integrated reservoir/pump/controller system that may be operated manually, automatically or by remote control. The invention is easily maintainable and may be left in a state of preparedness for use in the event of icing conditions. The liquid chemical deicing agent is contained in a temporary reservoir tank that is manually replaced. The temporary reservoir tank is placed upon the watertight base. The deicing agent is pumped from the watertight base to the distribution system. Apertures in the distribution system allow for the deicing agent to be distributed to any targeted surface. A primary benefit is a greatly increased margin of safety for the users of driveways, walkways, etc. to which the invention applies the deicing agents. Another benefit is a reduction in the injuries and deaths related to the physically strenuous activity of shoveling snow and ice.

101 Claims, 3 Drawing Sheets

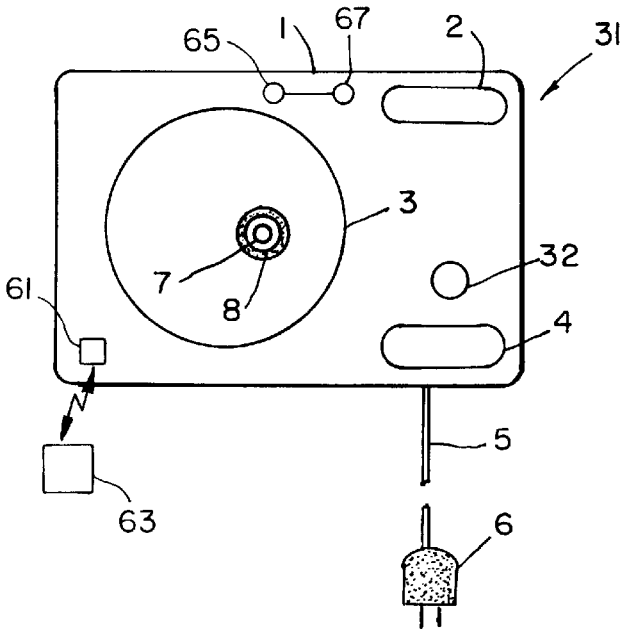
FIG. 1
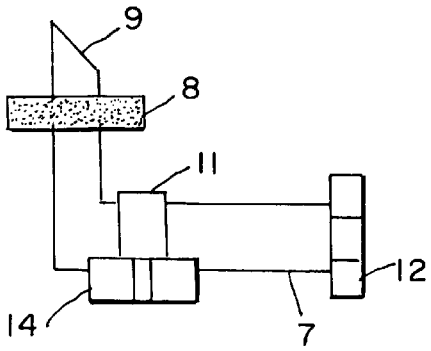
FIG. 2
FIG. 3A
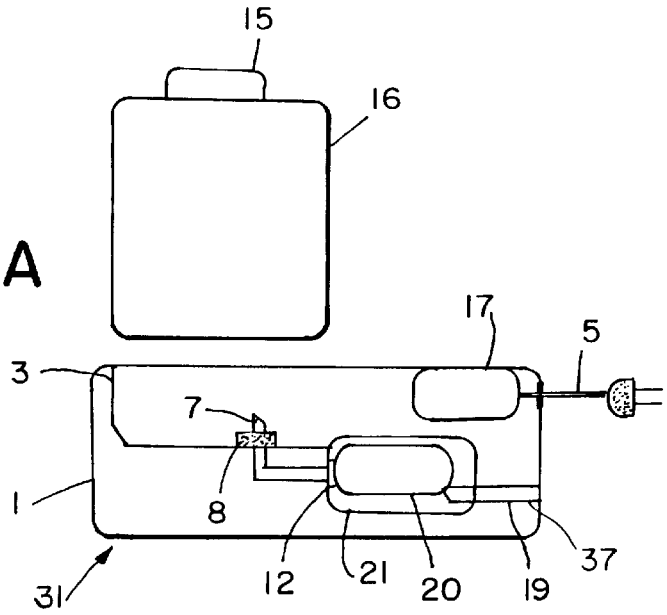

AUTOMATIC DEICING UNIT

This application claims the benefit of U.S. Provisional Application No. 60/037,136, filed Feb. 13, 1997.

BACKGROUND OF THE INVENTION

The application of deicing chemicals to surfaces is a well established practice, and devices used for applying chemicals currently exist. Such devices include wheel driven salt spreaders, truck mounted salt spinners and other mechanical systems, like that described in U.S. Pat. No. 3,201,006, an endless chain delivery system of a salt spreader. The inventor of this device, Bernard J. Ask, has received U.S. Pat. No. 5,447,272 for an automated deicing system, with both liquid and granular chemical variants. No small scale, integrated portable reservoir/pump/controller device is known, however, for providing for icing protection by a stationary, liquid deicing agent spreader for use on small surface areas.

SUMMARY OF THE INVENTION

The present invention relates to a machine that applies chemical deicing agents to any surface to be protected from snow and ice, i.e. driveways, walkways, rooftops, etc. More specifically, this device applies the chemical to the target surfaces by remote control or push-button operation in a manner intended to prevent snow and ice from forming a bond with the target surface. The device is a compact, integrated reservoir/pump/controller portable system.

An objective of the present invention is to provide a device that applies deicing agents, like a liquid chemical deicing compound, such as potassium acetate, calcium magnesium acetate, magnesium chloride etc., by automatic, manual or remote control means.

It is also an objective of the present invention to provide a device that can be easily maintained and left in a state of preparedness for use in the event of icing conditions.

Another objective of the invention is to allow for easy refilling of the liquid chemical deicing agent reservoir.

A primary benefit of attaining each of the above stated objectives is a greatly increased margin of safety for the users of the driveways, sidewalks etc. Additionally, removing the snow and ice through the use of chemicals means a reduction in the injuries and deaths related to the physical, strenuous activity of manually shoveling the snow and ice.

These and further and other objects and features of the invention are apparent in the disclosure, which includes the above and ongoing written specification, with the claims and the drawings.

BRIEF DESCRIPTION OF THE DRAWINGS

FIG. 1 is a top view of the automatic deicing unit.

FIG. 2 is a detail view of the piercing tube of the automatic deicing unit.

FIG. 3A is a side view of the automatic deicing unit.

DETAILED DESCRIPTION OF THE PREFERRED EMBODIMENTS

Figure 3B:
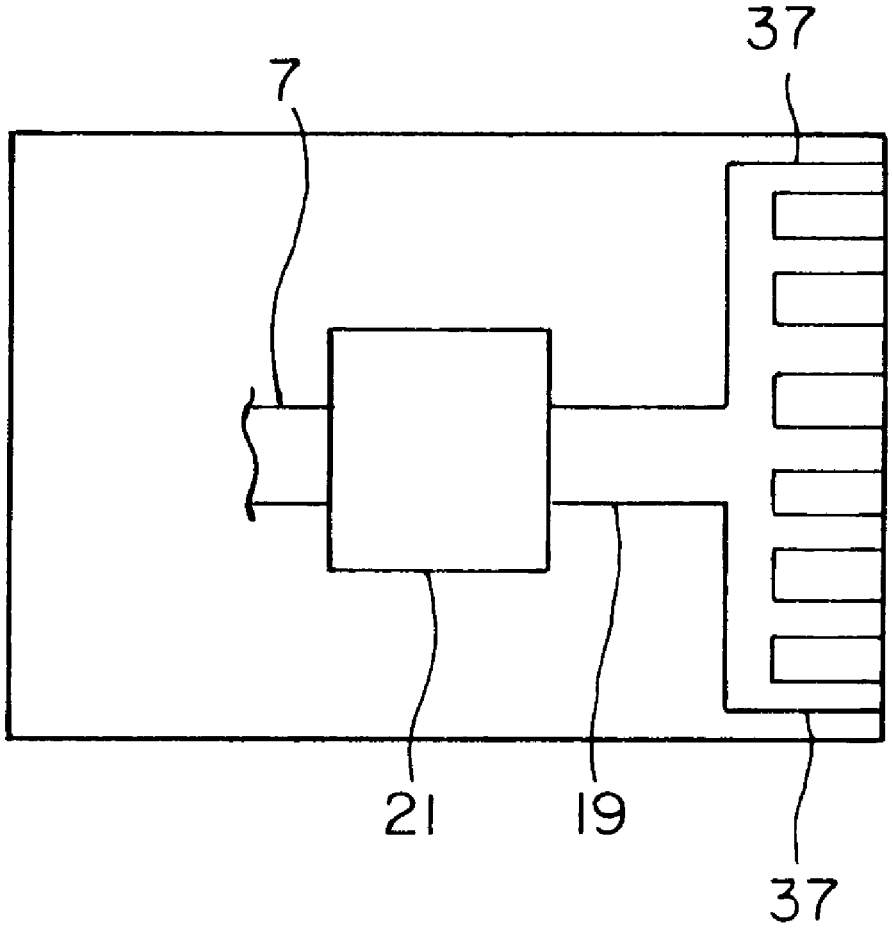
FIG. 3B is a cut-away top view of the automatic deicing unit showing the pump and outlet tube within the base unit.

A preferred embodiment of an automated anti-icing system 31, as shown in FIG. 1, is housed in a watertight base

1, with an indicator light 2 to indicate system status, i.e. low deicer level, system/power on, etc.

The base may have a watertight permanent reservoir 3 that also serves as a receptacle for a temporary reservoir (16, FIG. 3A) of the anti-icing chemical. Contained within the reservoir 3 is the anti-icing supply tube 7 shaped so that it pierces the base of the temporary reservoir.

The piercing tube 7 is ringed by a sealing gasket 8 for purposes of keeping the anti-icing chemical from leaking between the watertight reservoir 3 and the body of the piercing tube 7. The power cord 5 supplies 110 volts AC or 220 volts AC from the receptacle, into which the male electrical plug 6 is inserted. The power is carried through the cord 5 to the power supply 4 for the unit, which is contained in the body of the liquid tight base 1 of the deicing unit 31. Switch controlling circuitry 61 may be used for remotely activating the unit by touch-tone phone, personal computer or other wireless means 63.

The piercing tube 7, shown in FIG. 2, is a formed steel pipe that has a sharpened or shaped end 9 that pierces the base of the temporary reservoir tank (16 in FIG. 3A). The chemical flows from the temporary reservoir tank into the piercing tube 7 and exits at the tube outlet. The tube outlet is attached to the pumping assembly, shown in FIG. 3A, by means of a locking fastener 12. The piercing tube 7 is ringed by a watertight, flexible gasket 8 which prevents liquid from traveling along the piercing tube 7. The piercing tube 7 is affixed to the base by a locking strap 11 and affixed to a mounting block 14.

As shown in FIG. 3, the anti-icing unit 31 is a system of components designed to spray liquid chemical deicing agent that is contained in the temporary deicer reservoir 16. The temporary deicer reservoir 16 is inserted and removed by means of the molded container handle 15. The system power supply and control unit, with an on/off switch 17, is powered by the AC cord 5. The liquid chemical deicing agent temporary reservoir 16 is manually lowered into the receptacle reservoir 3 and onto the piercing tube 7, resting on the sealing gasket 8.

The liquid tight base 1 houses the pump enclosure 21 into which the piercing tube 7 is affixed by means of a locking ring 12. The liquid is forced into the inlet of the pump 20 by gravity, pressurized by the action of the pump and ejected through the outlet tube 19 to the distribution strip, as shown in FIG. 3B.

In another preferred embodiment, a battery back-up power supply 65 is used to operate the pump motor during periods of power failure or in the absence of available power. A solar cell battery charger 67 with current conditioning circuitry, cabling and mounting hardware may be used to provide a constant charge to the battery back-up power supply. Sensors 32 (FIG. 1) may be provided on the system for sensing ambient conditions and activating the deicer as and when required.

Figure 4:
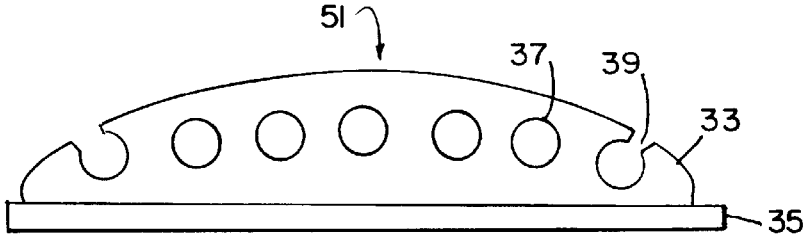
FIG. 4 is a cross section view of the extruded distribution strip.

The distribution strip body 33, shown in FIG. 4, rests on the distribution strip base 35. The distribution strip body 33 contains one or more internal tubes 37 that carry the liquid chemical deicing agent from the base unit onto the targeted surface. The internal tubes 37 have penetrations 39 from the walls of the distribution strip body 33 for ejecting the anti-icing liquid that travels through the internal tubes out of the internal tubes and onto the targeted surfaces.

Figure 5:
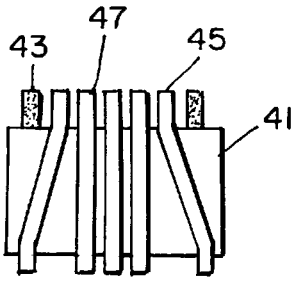
FIG. 5 is a top view of the connecting block.

The connecting block 41, shown in FIG. 5, is used to connect two or more distribution strips (shown in FIG. 4). The connecting block 41 has plugs 43 that seal the end of the outermost tubes of the distribution strip nearest the pump assembly. Distribution tubes 45 reroute the next pair of internal tubes from an interior position of the distribution strip nearest the pump assembly to the outermost position on the distribution strip attached to the connector block 41. The connecting block 41 also includes distribution tubes 47 that route the liquid chemical deicing agent through the internal tubes to the end of the distribution strip. In another preferred embodiment, the connecting block may be configured to connect from two to four distribution strips.

Figure 6:
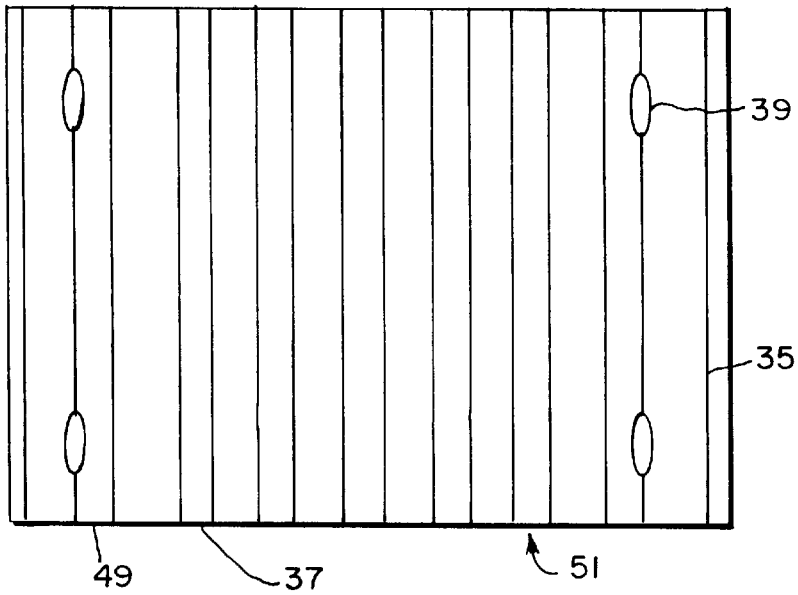
FIG. 6 is a top view of the distribution strip.

FIG. 6 shows a top view of the distribution strip 51 depicting the internal tubes 37 that number one or more, and the outermost tubes 49 that number one or more. Both tubes 37 and 49 are filled by liquid anti-icing chemicals delivered under pressure from the pumping assembly and ejected through the apertures 39 and onto the targeted surface upon which the distribution strip base 35 rests.

Figure 7:
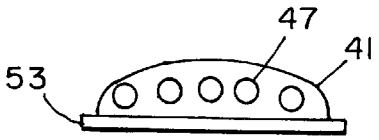
FIG. 7 is a cross section of the connector block.

The connector block 41 is of an identical cross sectional shape as the distribution block, as shown in FIG. 7. The connector block 41 rests on the connector block base 53. The connector block 41 is sized large enough for the ends of two or more distribution strips. The internal tubes are supplied with liquid anti-icing agents via connecting tubes 47.

While the invention has been described with reference to specific embodiments, modifications and variations of the invention may be constructed without departing from the scope of the invention, which is defined in the following claims.

We claim:

1. An automatic deicer apparatus comprising a portable reservoir tank, deicing agents in the tank, a watertight base for receiving the reservoir tank, a distribution system provided in the base for receiving the deicing agents from the tank, and at least one distribution strip connected to the base for receiving and applying the deicing agents from the distribution system to targeted surfaces.

2. The apparatus of claim 1, wherein the deicing agent is a liquid chemical deicing agent.

3. The apparatus of claim 1, further comprising a handle connected to the tank for removably positioning the tank on the base to facilitate insertion and removal of the tank as needed.

4. The apparatus of claim 1, further comprising a pump in the distribution system for pumping the deicing agents to the at least one distribution strip.

5. The apparatus of claim 4, further comprising a supply tube in the distribution system for connecting the tank to the pump.

6. The apparatus of claim 5, further comprising a sharp end on the supply tube for puncturing a side of the tank positioned in the base and for receiving the deicing agents.

7. The apparatus of claim 5, further comprising a gasket proximal the sharp end of the supply tube forming a tight seal between the tube and the tank thereby preventing leakage of the deicing agents.

8. The apparatus of claim 4, further comprising a locking ring on another end of the tube for a leak-proof connection between the tube and the pump.

9. The apparatus of claim 1, further comprising a power supply connected to the base for supplying power to the deicer.

10. The apparatus of claim 9, further comprising a switch control circuitry connected to the power supply.

11. The apparatus of claim 9, further comprising a wireless remote unit for remotely operating the deicer.

12. The apparatus of claim 11, wherein the wireless remote unit is selected from a group consisting of telephones, computers, and other wireless means.

13. The apparatus of claim 5, further comprising a mounting block in the base, and a locking strap connected to the base for holding the tube in the base.

14. The apparatus of claim 1, further comprising a permanent reservoir in the base for receiving the tank.

15. The apparatus of claim 1, further comprising indicators on the base for indicating power status of the deicer, and levels of the deicing agent.

16. The apparatus of claim 5, further comprising an outlet tube connected to the pump and the at least one distribution strip for supplying the deicing agents to the at least one distribution strip.

17. The apparatus of claim 1, further comprising at least one pipe within the at least one distribution strip for supplying deicing agents to targeted surfaces.

18. The apparatus of claim 17, wherein the at least one pipe has at least one opening through a body of the at least one distribution strip for ejecting the deicing agents to targeted surfaces.

19. The apparatus of claim 18, wherein the at least one pipe further comprises plural pipes.

20. The apparatus of claim 1, wherein the at least one distribution strip further comprises plural strips.

21. The apparatus of claim 20, wherein each strip comprises plural pipes forming plural inner and outer pipes within each plural strip.

22. The apparatus of claim 21, further comprising connecting blocks for inter-connecting the plural strips.

23. The apparatus of claim 22, wherein each connecting block connects a range between two to four strips.

24. The apparatus of claim 22, further comprising plugs on the connecting blocks for sealing the outer pipes.

25. The apparatus of claim 21, further comprising distribution tubes for connecting at least one of the inner pipes of one distribution strip to at least one of the outer pipes of another distribution strip.

26. The apparatus of claim 21, further comprising distribution tubes for routing the plural pipes of one distribution strip to the plural pipes of another distribution strip.

27. The apparatus of claim 9, further comprising an on/off switch connected to the power supply for turning on power to the deicer.

28. The apparatus of claim 1, further comprising switch control circuitry for remotely activating the deicer by a touch-tone phone.

29. The apparatus of claim 1, further comprising switch control circuitry for remotely activating the deicer by using a personal computer.

30. The apparatus of claim 1, further comprising switch control circuitry for remotely activating the deicer by wireless means.

31. The apparatus of claim 1, further comprising a battery back-up power supply for operating the pump in absence of available power.

32. The apparatus of claim 9, wherein the power supply is a battery back-up power supply.

33. The apparatus of claim 32, further comprising a solar cell battery charger for providing constant charge to the battery back-up power supply.

34. A deicer distribution apparatus comprising a portable watertight system having a base, a distribution system provided in the base for receiving and distributing deicing agents to targeted surfaces.

35. The apparatus of claim 34, wherein the distribution system comprises at least one distribution strip for receiving and applying the deicing agents from the distribution system to targeted surfaces.

36. The apparatus of claim 34, further comprising a reservoir in the base connected to the distribution system for receiving the deicing agents.

37. The apparatus of claim 34, further comprising a tank, and deicing agents in the tank, the tank being removably positioned on the base for supplying deicing agents to the distribution system as required.

38. The apparatus of claim 35, further comprising a pump in the distribution system for pumping the deicing agents to the at least one distribution strip.

39. The apparatus of claim 38, further comprising a supply tube in the distribution system connected to the pump.

40. The apparatus of claim 39, further comprising a sharp end on the supply tube.

41. The apparatus of claim 40, further comprising a portable tank and deicing agents in the tank, wherein the sharp end of the supply tube is for puncturing a side of the tank positioned on the base and for receiving the deicing agents.

42. The apparatus of claim 41, further comprising a gasket proximal the sharp end of the supply tube forming a tight seal between the tube and the tank thereby preventing leakage of the deicing agents.

43. The apparatus of claim 40, further comprising a locking ring on another end of the tube for a leak-proof connection between the tube and the pump.

44. The apparatus of claim 34, further comprising a power supply connected to the base for supplying power to the deicer.

45. The apparatus of claim 34, further comprising a switch control circuitry connected to the power supply.

46. The apparatus of claim 34, further comprising a wireless remote unit for remotely operating the deicer.

47. The apparatus of claim 46, wherein the wireless remote unit is selected from a group consisting of telephones, computers, and other wireless means.

48. The apparatus of claim 34, further comprising sensors on the base for sensing ambient conditions and for activating the deicer as needed.

49. The apparatus of claim 34, further comprising a mounting block in the base, and a locking strap connected to the base for holding the tube in the base on the mounting block.

50. The apparatus of claim 34, further comprising indicators on the base for indicating power status of the deicer, and levels of the deicing agent.

51. The apparatus of claim 35, further comprising an outlet tube connected to the pump and the at least one distribution strip for supplying the deicing agents to the at least one distribution strip.

52. The apparatus of claim 35, further comprising at least one pipe within the at least one distribution strip for supplying deicing agents to targeted surfaces.

53. The apparatus of claim 52, wherein the at least one pipe has at least one opening through a body of the at least one distribution strip for ejecting the deicing agents to targeted surfaces.

54. The apparatus of claim 44, further comprising an on/off switch connected to the power supply for turning on power to the deicer.

55. The apparatus of claim 34, further comprising switch control circuitry for remotely activating the deicer by a touch-tone phone.

56. The apparatus of claim 34, further comprising switch control circuitry for remotely activating the deicer by a personal computer.

57. The apparatus of claim 34, further comprising switch control circuitry for remotely activating the deicer by wireless means.

58. The apparatus of claim 39, further comprising a battery back-up power supply for operating the pump during power failure.

59. The apparatus of claim 44, wherein the power supply is a battery back-up power supply.

60. The apparatus of claim 59, further comprising a solar cell battery charger for providing constant charge to the battery back-up power supply.

61. A system for distributing deicing agents comprising a portable housing, a distribution system in the housing, and at least one distribution strip connected to the distribution system for receiving and applying deicing agents from the distribution system to targeted surfaces.

62. The system of claim 61, wherein the distribution system comprises a supply tube, a pump connected to the supply tube and to the distribution strip.

63. The system of claim 62, further comprising an outlet tube connecting the pump to the distribution strip.

64. The apparatus of claim 61, further comprising a reservoir in the housing connected to the distribution system for receiving the deicing agents.

65. The apparatus of claim 61, further comprising a tank, and deicing agents in the tank, the tank being removably positioned on the housing for supplying deicing agents to the distribution system as required.

66. The apparatus of claim 61, further comprising a pump in the distribution system for pumping the deicing agents to the at least one distribution strip.

67. The apparatus of claim 66, further comprising a supply tube in the distribution system connected to the pump.

68. The apparatus of claim 67, further comprising a sharp end on the supply tube.

69. The apparatus of claim 68, further comprising a gasket proximal the sharp end of the supply tube forming a tight seal between the tube and a reservoir supplying deicing agents for preventing leakage of the deicing agents.

70. The apparatus of claim 68, further comprising a locking ring on another end of the tube for a leak-proof connection between the tube and the pump.

71. The apparatus of claim 61, further comprising a power supply connected to the housing for supplying power to the distribution system.

72. The apparatus of claim 67, further comprising a mounting block in the base, and a locking strap connected to the base for holding the tube in the base on the mounting block.

73. The apparatus of claim 61, further comprising indicators on the housing for indicating power status of the deicer, and levels of the deicing agent.

74. The apparatus of claim 66, further comprising an outlet tube connected to the pump and the at least one distribution strip for supplying the deicing agents to the at least one distribution strip.

75. The apparatus of claim 61, further comprising at least one pipe within the at least one distribution strip for supplying deicing agents to targeted surfaces.

76. The apparatus of claim 75, wherein the at least one pipe has at least one opening through a body of the at least one distribution strip for ejecting the deicing agents to targeted surfaces.

77. The apparatus of claim 75, wherein the at least one pipe further comprises plural pipes.

78. The apparatus of claim 61, wherein the at least one distribution strip further comprises plural strips.

79. The apparatus of claim 78, wherein each strip comprises plural pipes forming plural inner and outer pipes within each plural strip.

80. The apparatus of claim 78, further comprising connecting blocks for inter-connecting the plural strips.

81. The apparatus of claim 80, wherein each connecting block connects a range between two to four strips.

82. The apparatus of claim 80, further comprising plugs on the connecting blocks for sealing the outer pipes.

83. The apparatus of claim 79, further comprising distribution tubes for connecting at least one of the inner pipes of one distribution strip to at least one of the outer pipes of another distribution strip.

84. The apparatus of claim 79, further comprising distribution tubes for routing the plural pipes of one distribution strip to the plural pipes of another distribution strip.

85. The apparatus of claim 66, further comprising a battery back-up power supply for operating the pump during power failure.

86. The apparatus of claim 71, wherein the power supply is a battery back-up power supply.

87. The apparatus of claim 86, further comprising a solar cell battery charger for providing constant charge to the battery back-up power supply.

88. An automatic deicing method comprising providing a portable distribution deicer system in a watertight base at a desired location, supplying deicing agents to the distribution system, providing at least one distribution strip in the distribution system, supplying the deicing agents to the distribution strip, and applying the deicing agents through the distribution strip to targeted surfaces.

89. The method of claim 88, wherein supplying the deicing agents comprises providing the deicing agents in a reservoir.

90. The method of claim 89, wherein providing deicing agents in a reservoir comprises a permanent reservoir in the base.

91. The method of claim 89, wherein providing deicing agents in a reservoir comprises providing the deicing agents in a portable reservoir tank, and positioning the portable tank on the base.

92. The method of claim 88, wherein the supplying deicing agents comprises pumping the deicing agents to the at least one distribution strip by a pump.

93. The method of claim 88, wherein the supplying comprises connecting a deicing source to a pump by providing a supply tube in the distribution system.

94. The method of claim 93, further comprising forming an end of the supply tube as a sharp end and puncturing a side of the deicing source positioned on the base for receiving the deicing agents.

95. The method of claim 94, further comprising providing a gasket proximal the sharp end of the supply tube, forming a tight seal between the tube and the source and preventing leakage of the deicing agents.

96. The method of claim 88, further comprising supplying power to the deicer via a power supply connected to the base.

97. The method of claim 96, further comprising connecting a switch control circuitry to the power supply.

98. The method of claim 88, further comprising remotely operating the deicer by a wireless remote unit.

99. The apparatus of claim 98, wherein the remotely operating by a wireless remote unit comprises operating by the unit selected from a group consisting of telephones, computers, and other wireless means.

100. The method of claim 88, further comprising operating a pump in the distribution system by a battery back-up power supply in the absence of available power.

101. The method of claim 100, further comprising constantly charging the battery back-up power supply by a solar cell battery charger.

* * * * *